US008813872B2

(12) United States Patent
Acquaviva

(10) Patent No.: US 8,813,872 B2
(45) Date of Patent: Aug. 26, 2014

(54) METHODS AND APPARATUS FOR DOWNLOAD TRANSFER OF DRILL CUTTINGS

(75) Inventor: Pierre-Jérôme Acquaviva, La Garde (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 780 days.

(21) Appl. No.: 12/516,435

(22) PCT Filed: Nov. 23, 2007

(86) PCT No.: PCT/EP2007/010913

§ 371 (c)(1), (2), (4) Date: Dec. 17, 2009

(87) PCT Pub. No.: WO2008/064923

PCT Pub. Date: Jun. 5, 2008

(65) Prior Publication Data

US 2010/0116552 A1 May 13, 2010

(30) Foreign Application Priority Data

Dec. 1, 2006 (EP) ..... 06125243

(51) Int. Cl.
*E21B 21/00* (2006.01)
*E21B 27/00* (2006.01)

(52) U.S. Cl.
CPC ..... *E21B 21/002* (2013.01)
USPC ..... 175/65; 175/312; 175/324

(58) Field of Classification Search
USPC ..... 175/65, 100, 312, 324; 210/170.01, 210/171, 359, 391, 393, 398, 433.1
See application file for complete search history.

(56) References Cited

U.S. PATENT DOCUMENTS 3,724,674 A 4/1973 Loison
4,137,177 A * 1/1979 Shoda ..... 210/403
4,475,603 A * 10/1984 Hayatdavoudi ..... 175/65

(Continued)

FOREIGN PATENT DOCUMENTS

EP 0033654 8/1981
GB 2127466 4/1984

(Continued)

OTHER PUBLICATIONS

Office action for the equivalent Canadian patent application No. 2670921issued on Dec. 11, 2013.

*Primary Examiner* — Kenneth L Thompson
*Assistant Examiner* — Michael Wills, III
(74) *Attorney, Agent, or Firm* — Stephanie Chi; Jody DeStefanis

(57) ABSTRACT

A drilling fluid delivery system for drilling boreholes with a drill bit, includes a primary flow circuit having a relatively high flow rate for transferring drilling fluid to and from the drill bit. The system also includes a secondary flow circuit having a relatively low flow rate for transferring drilling fluid to and from the primary flow circuit. Furthermore, the system includes a cuttings transfer system, such as a hydrocyclone or a rotating filter, between the primary and secondary flow circuits. When the cutting transfer system is in use, it receives fluid containing cuttings from the primary circuit and separates the fluid into a first stream that contains substantially no cuttings and a second stream containing cuttings. The first stream is returned to the primary flow circuit and the second stream is directed to the secondary flow circuit.

14 Claims, 2 Drawing Sheets

(56) References Cited

U.S. PATENT DOCUMENTS

| | | | | |
|---|---|---|---|---|
| 4,488,607 | A * | 12/1984 | Hayatdavoudi et al. | 175/65 |
| 4,688,650 | A * | 8/1987 | Hayatdavoudi et al. | 175/324 |
| 5,143,162 | A | 9/1992 | Lyon et al. | |
| 6,089,317 | A * | 7/2000 | Shaw | 166/265 |
| 6,138,758 | A * | 10/2000 | Shaw et al. | 166/265 |
| 6,189,613 | B1 * | 2/2001 | Chachula et al. | 166/265 |
| 6,213,208 | B1 * | 4/2001 | Skilbeck | 166/265 |
| 6,290,001 | B1 * | 9/2001 | West et al. | 175/61 |
| 6,378,608 | B1 * | 4/2002 | Nilsen et al. | 166/265 |
| 6,457,531 | B1 * | 10/2002 | Bangash et al. | 166/369 |
| 6,543,537 | B1 * | 4/2003 | Kjos | 166/266 |
| 6,715,570 | B1 * | 4/2004 | Downton et al. | 175/314 |
| 6,997,272 | B2 * | 2/2006 | Eppink | 175/61 |
| 7,188,687 | B2 * | 3/2007 | Rudd et al. | 175/171 |
| 7,188,688 | B1 * | 3/2007 | LeJeune | 175/312 |
| 7,487,838 | B2 * | 2/2009 | Knight et al. | 166/369 |
| 7,926,592 | B2 * | 4/2011 | Smith et al. | 175/81 |
| 2002/0060181 | A1 * | 5/2002 | Schreiber | 210/396 |
| 2004/0154805 | A1 * | 8/2004 | Fontana et al. | 166/358 |
| 2004/0195007 | A1 * | 10/2004 | Eppink | 175/61 |
| 2006/0157282 | A1 * | 7/2006 | Tilton et al. | 175/65 |

FOREIGN PATENT DOCUMENTS

| | | |
|---|---|---|
| GB | 2335218 | 9/1999 |
| GB | 2398308 | 8/2004 |
| WO | 9850131 | 11/1998 |
| WO | 0058602 | 10/2000 |

* cited by examiner

METHODS AND APPARATUS FOR DOWNLOAD TRANSFER OF DRILL CUTTINGS

TECHNICAL FIELD

This invention relates to methods and apparatus for transferring drill cuttings from one circulation system to another in a drilling assembly. In particular the invention relates to the use of such methods and apparatus as part of a downhole drilling system.

BACKGROUND ART

In the drilling of underground wells such as oil and gas wells, drilled cuttings are normally transported from the drill bit to higher in the well or to the surface by pumping a drilling fluid (sometimes called drilling 'mud') down through the drill string to return up the well via the annulus around the drill string, carrying the cuttings back up the annulus with the fluid. In reverse circulation, drilling fluid is pumped down the annulus to the drill bit and returns to the surface through the drill string.

A sufficient fluid velocity is required in the return path to transport the cuttings. If the cuttings are to be transported over a long distance, for example back to the surface, it can be more useful to have a small conduit with a lower flow rate, rather than a bigger conduit with a higher flow rate. This is because for the same length, a small conduit typically has a lower footprint at the surface and is lighter. If deployment under pressure in the well is required, a smaller conduit is easier to seal and has a higher resistance to collapse, and the power required to move a liquid over a long distance at a given velocity is lower for a smaller conduit. However it is also useful to have a higher flow rate around the bottom hole assembly to ensure good cooling of the assembly and drill bit, and good cleaning of the drill bit.

In certain drilling applications, it can be desirable to separate cuttings from the circulating drilling fluid downhole. For example, GB 2 398 308 describes a drilling system having a downhole motor and fluid pump powered via a wireline cable and used for drilling lateral boreholes from a main well. Cuttings-laden fluid from the lateral well being drilled are diverted through a cuttings catcher where the cuttings are retained while the drilling fluid returns to the circulation system via a circulation tube. This avoids the need to circulate cuttings-laden fluid long distances back up the main well or to the surface.

It is an object of the invention to provide a drilling system that can offer the benefits of both high flow rate at the bit and low flow rate to the surface.

Therefore the invention proposes a method and apparatus based on the use of two circulation loops, a high flow rate loop and a low flow rate loop, and a separation device for transferring cuttings between the flows in the two loops.

DISCLOSURE OF THE INVENTION

A first aspect of the invention comprises a drilling fluid delivery system for use in drilling boreholes with a drill bit, the system comprising:

- a primary flow circuit having a relatively high flow rate for transferring drilling fluid to and from the drill bit;
- a secondary flow circuit having a relatively low flow rate for transferring drilling fluid to and from the primary flow circuit; and

- a cuttings transfer system between the primary and secondary flow circuits which, in use, receives fluid containing cuttings from the primary circuit, separates the fluid into a first stream that contains substantially no cuttings and a second stream containing cuttings, the first stream being returned to the primary flow circuit and the second stream being directed to the secondary flow circuit.

Preferably, the primary and secondary flow circuits comprise flow conduits, the primary flow circuit having a wider conduit than the secondary flow circuit.

The primary flow circuit can be a shorter length than the secondary flow circuit. Having a short primary flow circuit around the bottom hole drilling assembly allows fluid to flow at a high flow rate and get good cooling of the assembly and drilling bit and good bit cleaning. The longer secondary flow circuit with a low flow rate allows for fluid to flow the long distance between the surface and the bottom hole assembly.

A system according to the invention typically comprises a tool body defining parts of the primary and secondary flow circuits and the cuttings transfer system.

In one particularly preferred embodiment, the cuttings transfer system comprises a hydrocyclone which receives fluid with cuttings at a high flow rate from the primary circuit, and discharges the fluid with cuttings at a low flow rate via an underflow outlet into the secondary circuit and discharges fluid not containing cuttings from the hydrocyclone back into the primary circuit.

Preferably the tool body also comprises a passageway to discharge fluids not containing cuttings from the hydrocyclone to the annulus above the drill bit.

In another preferred embodiment of the invention, the cuttings transfer system comprises a filter. Preferably, the filter comprises a rotating sieve to transfer the cuttings from the fluid flowing in the primary circuit to the fluid flowing through the secondary circuit.

Preferably the system comprises a nozzle through which fluid flowing in the secondary circuit is accelerated prior to flowing through the filter. Accelerating the secondary flow through the nozzle helps ensure a good back flush of the cuttings is obtained.

In one embodiment, the system comprises a hollow axis forming part of the secondary circuit and around which the sieve can rotate.

A drilling apparatus according to the invention comprises a bottom hole drilling assembly and system as defined above located in the bottom hole drilling assembly. Locating the apparatus in the bottom hole assembly close to the drill bit, will minimise the length that the primary circuit needs to be and as such the length that fluid has to be pumped at a high flow rate, whilst the drill bit and drill assembly still get the benefits of fast fluid flow, i.e. for cooling and cleaning the drill bit.

The invention also provides a method of delivering drilling fluid for use in drilling boreholes with a drill bit, the method comprising:

- transferring drilling fluid to and from the drill bit by means of a primary flow circuit having a relatively high flow rate;
- transferring drilling fluid to and from the primary flow circuit by means of a secondary flow circuit having a relatively low flow rate;
- receiving fluid containing cuttings from the primary circuit in a cuttings transfer system between the primary and secondary flow circuits;
- separating the fluid in the cuttings transfer system into a first stream that contains substantially no cuttings and a second stream containing cuttings;

returning the first stream to the primary flow circuit; and directing the second stream to the secondary flow circuit.

In one embodiment, the step of separating the fluid into first and second streams comprises directing fluid from the primary circuit into a hydrocylone, directing fluid containing cuttings in the primary vortex to the secondary circuit, and directing fluid that is substantially free of cuttings in the secondary vortex to the primary circuit.

In another embodiment, the step of separating the fluid into first and second streams comprises directing fluid from the primary circuit onto a rotating sieve in a first zone so as to deposit cuttings thereon, directing fluid that is substantially free of cuttings back to the primary circuit, directing fluid from the secondary circuit in a second zone so as to flush cuttings from the sieve, and directing fluid containing cuttings to the secondary circuit.

Further embodiments of the invention will be apparent from the description below.

MODE(S) FOR CARRYING OUT THE INVENTION

Figure 1:
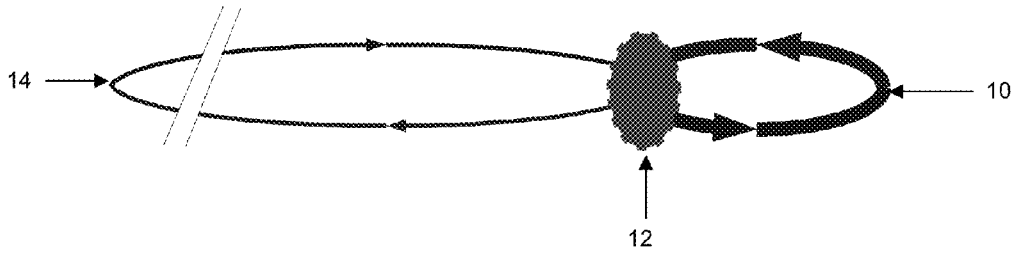
FIG. 1 shows a schematic of the primary and secondary circulation loops.

With reference to FIG. 1, fluid flows through the short primary circuit 10 at a high flow rate and collects cuttings. While the fluid is still flowing downhole, cuttings from the primary circuit 10 are transferred 12 to the fluid flowing through the long secondary circuit 14 where they are transported away at a low flow rate. Such a system can work well in applications typically found in the oil and gas drilling industry for a primary circuit flow rate of about 10 gallons per minute and a secondary circuit flow rate of about 2 gallons per minute.

Figure 2:
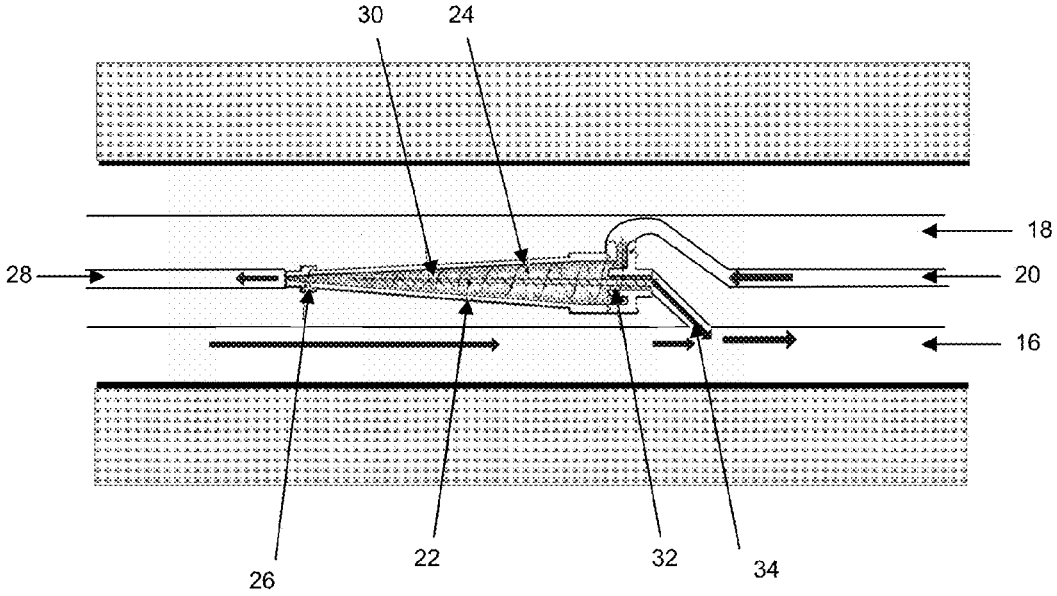
FIG. 2 shows a hydrocyclone in a down hole tool.

FIG. 2 shows an embodiment of the invention used is a reverse circulation application in which drilling fluid is pumped down the annulus 16 around a BHA and drill bit (not shown) and then passes up inside the BHA to a tool body 18. The tool body 18 includes a first flow passage 20 leading from the drill bit to a hydrocyclone 22 embedded in the tool body 18. Fluid containing cuttings from the first flow passage 20 (which forms part of the primary circuit 10) enters the hydrocyclone 22 tangentially under pressure and at high flow rate. As a result of the high centrifugal forces, cuttings migrate into a primary vortex 24 adjacent to the wall of the hydrocyclone. The cuttings move towards an underflow outlet (spigot) 26 and discharge into a second flow passage 28 (forming part of the secondary circuit 14) with a low flow rate of fluid. The remaining fluid in the hydrocyclone 22 is free of cuttings, i.e. 'clean' fluid, and migrates into a secondary vortex 30 moving in the core of the hydrocylcone in the opposite direction of the primary vortex 24. This cuttings-free fluid discharges out of the hydrocyclone through a vortex finder 32 into a discharge passage 34 and out into the annulus 16 between the tool body 18 and borehole wall. The space below the discharge outlet comprises part of the primary circuit and the fluid can flow through at a high flow rate. Cuttings-free fluid being pumped through the secondary circuit 14 joins the cuttings-free fluid discharged from the hydrocyclone 22 in the primary circuit 12.

The following example of the apparatus as show in FIG. 2, is presented to address a flow rate with a 10 gallons per minute in the primary circuit 10 and a 2 gallons per minute flow in the secondary circuit 14 and a hydrocyclone that is a 2-inch cyclone and 1.5 foot long with the following properties and working conditions:

Feed:
- a. 10 gpm (2.3 $m^3$/hr)
- b. Cuttings load=2%
- c. Cuttings size: 95%<200 microns. Accidentals up to 2 mm.

Figure 3:
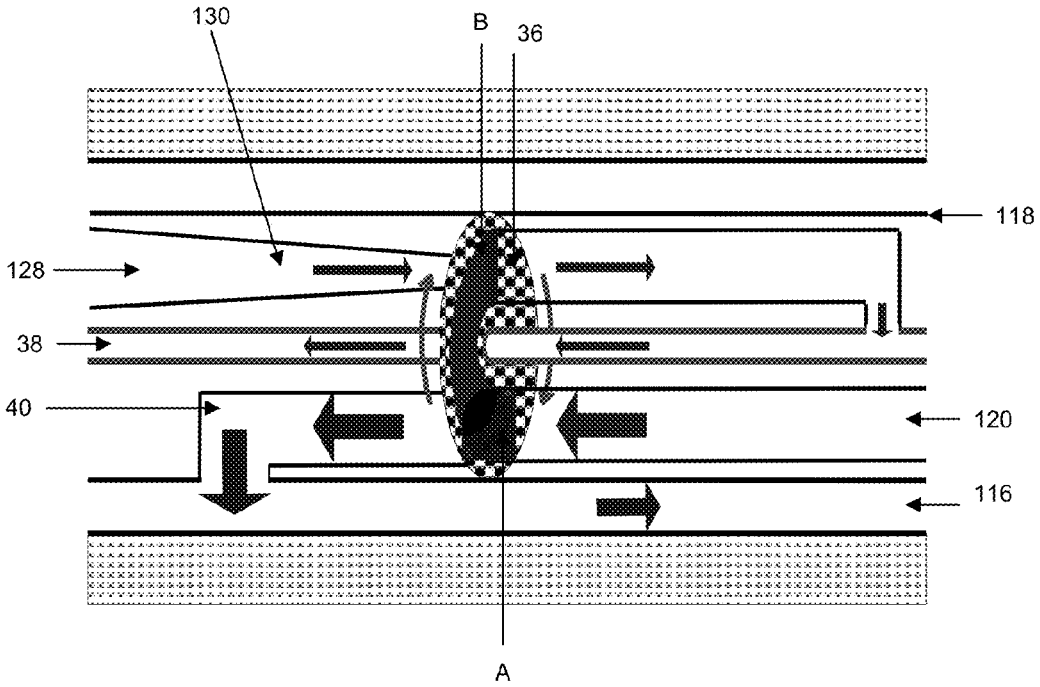
FIG. 3 shows a rotary disc filter in a down hole tool.

Underflow and spigot:
- a. 2 gpm (0.45 $m^3$/hr)
- b. Cuttings load=10% volume
- c. Spigot diameter=4.5 mm Overflow and vortex finder:
- a. 8 gpm
- b. vortex finder diameter=11 mm Performance:
- a. Pressure drop of primary circuit=45 psi
- b. Power loss=195 W
- c. D50<10 microns FIG. 3 shows another embodiment of the invention comprising a rotary filter disc or sieve 36 in the tool body 118. The rotary filter disc 36 is arranged to rotate at a substantially constant speed around a hollow axis 38 and intersects with the first and second passageways 120, 128 of the primary and secondary circuits 10, 14 that are in the tool body 118. Fluid with cuttings in the primary circuit 10 flows at a high flow rate through the first passageway 120 and is forced through the rotating filter 36 in a first zone A, leaving its cutting trapped in the filter 36 while the fluid that has flowed through the filter 36 is now free of cuttings and flows through a discharge port 40 and into the annulus 116 at high flow rate in the primary circuit 10. As the filter 36 rotates, the cuttings are transferred to a second zone B where the second passageway 128 directs fluid to flow through the filter 36. The cuttings on the filter 36 are flushed off by the fluid flowing through the second passageway 128 into the secondary circuit 14. The secondary circuit fluid loaded with cuttings is then transported away at a low flow rate through the hollow rotating axis 38.

The following details address an embodiment of the invention as shown in FIG. 3, giving a flow rate of 10 gallons per minute in the primary circuit and 2 gallons per minute in the secondary circuit. The mesh size of the filter can be about 50 to 70 microns and the disc rotation speed is about 120 rpm. The filter rotates fast enough to ensure that the cuttings do not accumulate on the filter. The primary fluid will hit the filter at about 1.5 m/s over a 400 $mm^2$ area of the filter while secondary fluid will back flush the filter at 4 m/s over a 31 $mm^2$ area of the filter. In some embodiments, the secondary flow can be accelerated through a nozzle 130 prior to flowing through the filter, to ensure that good back flush is achieved.

The apparatus allows clean fluid in the primary circuit 10 to be directed back towards the drill bit at a high flow rate, while the fluid with cuttings in the secondary circuit 14 can be transported upwards towards to the surface at a low flow rate, where the cuttings may be removed via known methods at the surface and clean drilling fluid pumped back down through the annulus towards the bottom hole assembly.

Changes may be made while still remaining within the scope of the invention.

The invention claimed is:

1. A method of delivering drilling fluid for use in drilling boreholes with a drill bit, the method comprising:

transferring drilling fluid to and from the drill bit by means of a primary flow circuit having a first flow rate;

transferring drilling fluid to and from the primary flow circuit by means of a secondary flow circuit having a second flow rate, wherein the first flow rate is higher than the second flow rate;

receiving fluid containing cuttings from the primary circuit in a cuttings transfer system between the primary and secondary flow circuits;

separating the fluid in the cuttings transfer system into a first stream that contains substantially no cuttings and a second stream containing cuttings;

returning the first stream to the primary flow circuit; and directing the second stream to the secondary flow circuit;

wherein the step of separating the fluid into first and second streams comprises directing fluid from the primary circuit into a hydrocyclone having a primary vortex and a secondary vortex, directing fluid containing cuttings in the primary vortex to the secondary circuit, and directing fluid that is substantially free of cuttings in the secondary vortex to the primary circuit.

2. A method of delivering drilling fluid for use in drilling boreholes with a drill bit, the method comprising:

transferring drilling fluid to and from the drill bit by means of a primary flow circuit having a first flow rate;

transferring drilling fluid to and from the primary flow circuit by means of a secondary flow circuit having a second flow rate, wherein the first flow rate is higher than the second flow rate;

receiving fluid containing cuttings from the primary circuit in a cuttings transfer system between the primary and secondary flow circuits;

separating the fluid in the cuttings transfer system into a first stream that contains substantially no cuttings and a second stream containing cuttings;

returning the first stream to the primary flow circuit; and directing the second stream to the secondary flow circuit;

wherein the step of separating the fluid into first and second streams comprises directing fluid from the primary circuit onto a rotating sieve in a first zone so as to deposit cuttings thereon, directing fluid that is substantially free of cuttings back to the primary circuit, directing fluid from the secondary circuit in a second zone so as to flush cuttings from the sieve, and directing fluid containing cuttings to the secondary circuit.

3. An apparatus, comprising:

a drilling fluid delivery system comprising:

a primary flow circuit to transfer drilling fluid at a first flow rate to and from a drill bit coupled to a bottom hole assembly (BHA);

a secondary flow circuit to transfer drilling fluid at a second flow rate to and from the primary flow circuit, wherein the first flow rate is higher than the second flow rate;

a hydrocyclone to separate fluid received from the primary flow circuit into:

a first stream that contains substantially no cuttings and is directed to the primary flow circuit; and a second stream that contains cuttings and is directed to the second flow circuit; and a tool body comprising portions of the primary and secondary flow circuits and the hydrocyclone.

4. The apparatus of claim 3 wherein a conduit of the primary flow circuit is wider than a conduit of the secondary flow circuit.

5. The apparatus of claim 4 wherein the primary flow circuit is shorter in length than the secondary flow circuit.

6. The apparatus of claim 5 wherein the tool body comprises a first flow passage between the drill bit and the hydrocyclone, and wherein the first flow passage forms part of the primary flow circuit.

7. The apparatus of claim 6 wherein the hydrocyclone is operable to internally form:

a primary vortex comprising fluid and cuttings; and a secondary vortex comprising fluid and substantially no cuttings.

8. The apparatus of claim 7 wherein the primary vortex moves in a first direction, and wherein the secondary vortex moves in a second direction opposite the first direction.

9. The apparatus of claim 8 wherein the first flow rate is about 10 gallons per minutes and the second flow rate is about 2 gallons per minute.

10. The apparatus of claim 3 wherein the primary flow circuit is shorter in length than the secondary flow circuit.

11. The apparatus of claim 3 wherein the tool body comprises a first flow passage between the drill bit and the hydrocyclone, wherein the first flow passage forms part of the primary flow circuit.

12. The apparatus of claim 3 wherein the hydrocyclone is operable to internally form:

a primary vortex comprising fluid and cuttings; and a secondary vortex comprising fluid and substantially no cuttings.

13. The apparatus of claim 12 wherein the primary vortex moves in a first direction, and wherein the secondary vortex moves in a second direction opposite the first direction.

14. The apparatus of claim 3 wherein the first flow rate is about 10 gallons per minutes and the second flow rate is about 2 gallons per minute.

* * * * *

UNITED STATES PATENT AND TRADEMARK OFFICE

CERTIFICATE OF CORRECTION

PATENT NO. : 8,813,872 B2
APPLICATION NO. : 12/516435
DATED : August 26, 2014
INVENTOR(S) : Pierre-Jerome Acquavita It is certified that error appears in the above-identified patent and that said Letters Patent is hereby corrected as shown below:

On the title page, item (75) the sole inventor's name should be corrected as follows.

Correct: Pierre-Jerome Acquavita

Incorrect: Pierre-Jérôme Acquavita

Signed and Sealed this
Ninth Day of December, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,813,872 B2
APPLICATION NO. : 12/516435
DATED : August 26, 2014
INVENTOR(S) : Pierre-Jerome Acquaviva It is certified that error appears in the above-identified patent and that said Letters Patent is hereby corrected as shown below:

On the title page, item (75) the sole inventor's name should be corrected as follows.

Correct: Pierre-Jerome Acquaviva

Incorrect: Pierre-Jérôme Acquaviva

This certificate supersedes the Certificate of Correction issued December 9, 2014.

Signed and Sealed this
Sixteenth Day of June, 2015

Michelle K. Lee

Michelle K. Lee
*Director of the United States Patent and Trademark Office*